US006499397B2

(12) United States Patent
Stern

(10) Patent No.: US 6,499,397 B2
(45) Date of Patent: Dec. 31, 2002

(54) METHOD OF AUTOMATIC REGISTER SETTING OF PRINTINGS IN A ROTARY MACHINE AND DEVICE FOR WORKING THE METHOD

(75) Inventor: Nathan Stern, Bussigny (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 09/782,091

(22) Filed: Feb. 12, 2001

(65) Prior Publication Data

US 2001/0022143 A1 Sep. 20, 2001

(30) Foreign Application Priority Data

Feb. 10, 2000 (CH) ..... 0269/00

(51) Int. Cl.[7] ..... B41F 13/02; B65H 23/18

(52) U.S. Cl. ..... 101/248; 101/181; 101/228; 101/485; 226/2; 226/28

(58) Field of Search ..... 101/178, 180, 101/181, 182, 211, 225, 228, 248, 481, 484, 485, 486; 226/2, 24, 27, 28, 29

(56) References Cited

U.S. PATENT DOCUMENTS 3,594,552 A * 7/1971 Adamson et al. ..... 101/181
3,858,052 A * 12/1974 Luska ..... 101/248
4,214,524 A * 7/1980 Corse ..... 101/181
4,264,957 A * 4/1981 Pautzke ..... 227/28
4,528,630 A * 7/1985 Sargent ..... 101/181
5,771,811 A * 6/1998 Siler et al. ..... 101/486
5,777,879 A * 7/1998 Sommerfeldt ..... 226/27
6,092,466 A * 7/2000 Koch et al. ..... 101/485
6,129,015 A * 10/2000 Dewey ..... 101/211

FOREIGN PATENT DOCUMENTS

CH 539509 * 9/1973
EP 0070565 1/1983

* cited by examiner

*Primary Examiner*—Stephen R. Funk
(74) *Attorney, Agent, or Firm*—Ostrolenk, Faber, Gerb & Soffen, LLP

(57) ABSTRACT

Device and method for the automatic register setting of printings printed by plate cylinders in a rotary machine using inks of a plurality of colors. The printing machine particularly comprises a succession of printing units, at least one pulse generator, two pull rollers located downstream of the printing units, a combination of plate cylinders and compensating rollers to correct some register errors, scanning heads each located near and downstream to the respective printing units. Each printing unit particularly includes one of the plate cylinders as well as one of the pressing cylinders. Each pressing cylinder is controlled by a control unit.

11 Claims, 6 Drawing Sheets

METHOD OF AUTOMATIC REGISTER SETTING OF PRINTINGS IN A ROTARY MACHINE AND DEVICE FOR WORKING THE METHOD

FIELD OF THE INVENTION

The present invention is related to a method of automatic register setting of printings in a rotary machine and to a device for working the method.

1. Background of the Invention

The method refers in particular to the automatic register setting of printings printed by plate cylinders in a rotary machine such as a heliographic, flexographic or other printing machine, printing a web such as paper, cardboard or a flexible material like, for example, polyethylene.

2. Description of the Related Art

This kind of machine usually comprises several printing units placed one after another and each printing a different color. A printing unit includes a plate cylinder and a pressing cylinder between which travels the material to be printed. The plate cylinder is either and engraved cylinder or a cylinder equipped with a printing plate reproducing the printing pattern. To obtain a perfect result, it is necessary that the various printings performed by the printing units are accurately superimposed. Each printing unit prints a register mark on the material web and the register setting of the various colors is achieved by superimposing the various register marks by acting, for example, on the lengthening or on the tension of this web by means of one or more compensating rollers arranged between the printing units. Such a method of register setting is described in patent CH 539 509. This method determines the register error at a printing station, then, from the result of this determination is calculated, according to the travelling of the web, a reference tension or lengthening of this web between the printing station concerned and the preceding one, this tension or this lengthening allowing an optimal correction of the register error. The following operation consists in comparing the reference tension or lengthening with the real tension or lengthening of the web between the printing station in question and the preceding one, in order to act on the web according to the result of this comparison in order to bring the tension or lengthening of the web to the value of the reference tension or lengthening.

This method requires of course a register mark scanning which requires the creation of a scanning gate in order to be absolutely sure to scan only the marks previously printed on the web, excluding any other printing part. Usually, the register marks are printed on a space free of any other printing, for example between two printed patterns or images, or in one of the edges of the web called "bank edge". Patent CH 548 933 describes in detail a method of obtaining a scanning gate.

It is quite clear that this method of register setting will function accurately only at constant operating speed of the printing machine, i.e. in the production phase, but when starting the machine, it will first be necessary to adjust the various plate cylinders with one another. This operation is carried out manually by the machine operator or by means of a system of prepositioning. To do so, the operator will carry out a manual presetting of the plate cylinders and/or the compensating rollers in order to bring all the register marks printed by each plate cylinder in the space defined by the scanning gate. Then he will enter into the memory of the calculator of the register setting device various parameters such as the data related to the angular position of the plate cylinders, the data related to the position of the compensating rollers, as well as other information so that, when repeating the same job, it will not be necessary to start again this operation.

This presetting can also be realized by calculating the angular position of the plate cylinders according to the web length between two printing units and to the circumference of the plate cylinders which corresponds to the printing size. In this calculation, the ratio must necessarily be an integral number.

After this presetting, it may occur that the position of the register marks is somewhat out of the limits of the scanning gate. If required, a repositioning should be carried out, to bring these register marks back in this gate by an additional operation called "phasing". It may even occur that, the presetting having been badly done, the marks are within the printing and that the phasing is not possible to be carried out, in this case a new setting will be necessary.

Generally in the prior art, the various stages for adjusting the cylinders and/or compensating rollers require at least the following operations: the operator will first arrange the plate cylinders in their respective position according to their point of reference. Then he will preposition the cylinders and/or compensating rollers by modifying, in that case, the web length between the printing units. He will then carry out a rough manual setting at slow run before proceeding with the phasing operation by means of an oscilloscope or automatically by means of a code. Resulting from this last stage, necessary corrections will be made in a new manual register which will imply by recurrence effect a new phasing operation followed by precise adjustments before being able to undertake the production phase.

The application of the operations just described hereinbefore involves, in most cases, a high consumption of web for bringing the machine, from the start-up phase, to a constant operating speed in the production phase.

This high consumption of web comes from several factors but principally from the fact that the presetting of the plate cylinders and/or compensating rollers is carried out visually by the machine operator and that he may make important appreciation errors in setting at once all the plate cylinders. Indeed, a bad setting may involve that the register mark is not printed in the scanning gate, in which case there is no possible phasing. Moreover, at the time of the start-up, the possibility of setting errors can be to the maximum of more or less a half printing size if the presetting is not correct, with the risk that the register mark is printed in the area corresponding to the printed image so that any detection of the register mark and hence any phasing is impossible. Numerous other problems affect the setting operation of the plate cylinders which depends in particular on the precision in inserting the cylinders, on the variety of the substrates used, on the different tension levels of the web between the printing units or the sometimes variable webs. These parameters, to quote only those, are often difficult to control. They cause inaccuracies which have repercussions in series and intensify downstream between the various printing units in order to finally exceed the tolerable values specified for the automatic register setting.

To face competition and to increase the flexibility of the services offered in the field of industrial graphic arts, the production series became increasingly smaller thus causing frequent job changes. These changes cause much waste paper and lost time in the preparation phase, which will finally reflect on the cost prices of the finished products.

The aim of the present invention is to overcome the aforecited disadvantages and particularly to reduce on a large scale the time and the consumption of web when setting a rotary printing machine.

BRIEF DESCRIPTION OF THE INVENTION

The invention, such as described hereafter, allows a simple and automatic register setting which authorizes a maximal initial register error. The method is the same for the preparation of a new job or about an old job. The data relating to the web and to the length between the units are not necessary any more. The phasing and the register setting are done with only one color which avoids any misunderstanding or overlapping of the marks resulting from several overprintings. The corrections of the register errors can be settled very quickly by moving the compensating rollers at high speed, typically about 15 mm/s, without causing any change in the web tension. A possible error of the web path in its travelling around the numerous idling rollers used between the printing units, for example for the web drying, modifies without consequence the length of the web path. According to the invention, the register setting method is not affected by an operation which requires the change of a plate cylinder or a pressing cylinder. Finally, owing to the method of this invention, the printing units must not necessarily be adjacent to one another. It may occur that, for example for maintenance, any printing unit is set out of function in the middle of the rotary printing machine. This setting out of function would not disturb in any way the automatic register setting method.

BRIEF DESCRIPTION OF THE DRAWINGS

The invention will be more readily understood from one embodiment taken purely by way of example without limiting force and illustrated in the accompanying drawings wherein.

DETAILED DESCRIPTION OF THE INVENTION

Figure 1:
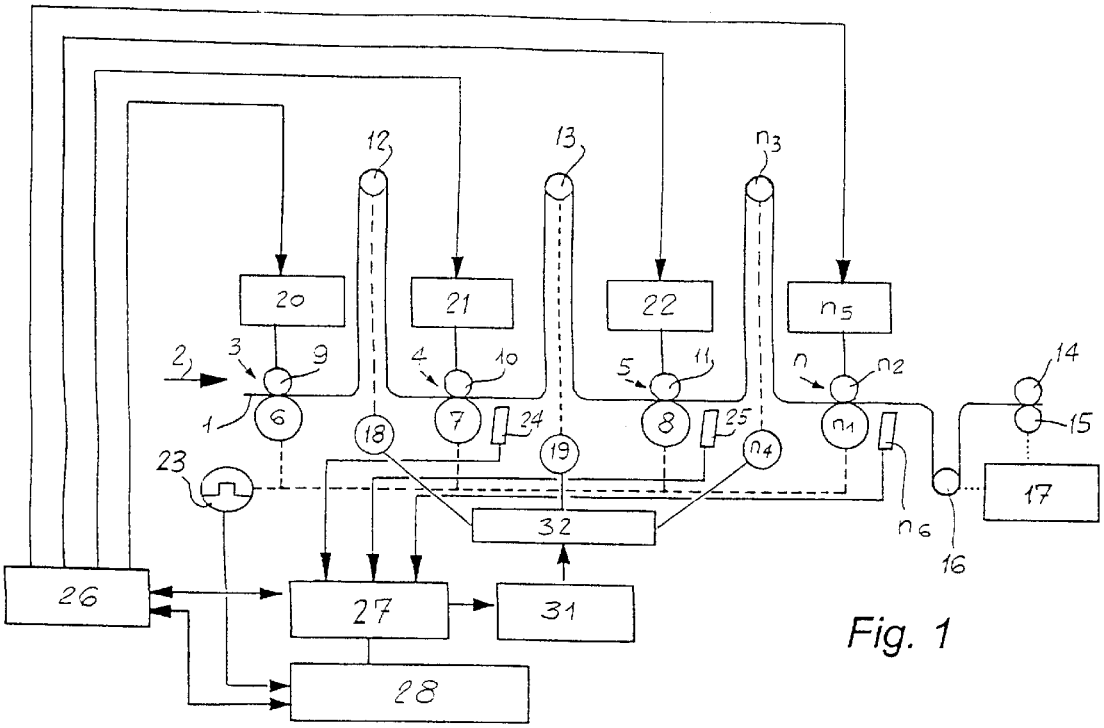
FIG. 1 is a schematic view of the components of a rotary printing machine equipped with compensating rollers.

FIG. 1 is a schematic view of the components of a rotary printing machine equipped with compensating rollers. The web to be printed 1 travels in the direction shown by arrow 2. This web to be printed 1 successively travels through the printing units 3, 4, 5 and n. The reference n is used here because of the fact that the rotary printing machine may include a plurality of consecutive printing units. Each printing unit 3 to n comprises a plate cylinder 6, 7, 8 and n1 as well as a pressing cylinder 9, 10, 11 and n2. In the embodiment shown in FIG. 1, compensating rollers 12, 13 and n3 are positioned between the printing units 3 and 4, 4 and 5, 5 and n. The last printing unit n is followed by a control device 17 of the web tension controlling two pull rollers 14 and 15 and receiving information from a tension sensor 16 constituted by a dancer roller, a tension detector or another equivalent device. Each compensating roller 12, 13 and n3 is controlled by its respective motor 18, 19 and n4. The pressing cylinders 9, 10, 11 and n2 are vertically moved by a control device 20, 21, 22 and n5. The plate cylinders 6, 7, 8 and n1 are coupled with a single pulse generator 23. The outputs of the printing units 4, 5 and n are equipped with scanning heads 24, 25 and n6 for scanning the position of the register marks printed on the web 1 by each plate cylinder 6 to n1. The control devices 20, 21, 22 and n5 of the pressing cylinders 9, 10, 11 and n2 are controlled by a control circuit 26 which is connected on the one hand with a calculating circuit of the register error 27 and on the other hand with a calculating circuit of angular position 28 of the plate cylinders 6, 7, 8 and n1. The calculating circuit of angular position 28 further receives an information coming from the pulse generator 23 connected to each plate cylinder 6, 7, 8 and n1. The calculating circuit of angular position 28 is connected to the calculating circuit of register error 27 which receives information from the scanning heads 24, 25 and n6. The calculating circuit of register error 27 generates an information to be sent to a register regulator 31 which generates an information for the control circuit 32 of the motors 18, 19 and n4 causing the moving of the compensating rollers 12, 13 and n3.

Figure 2:
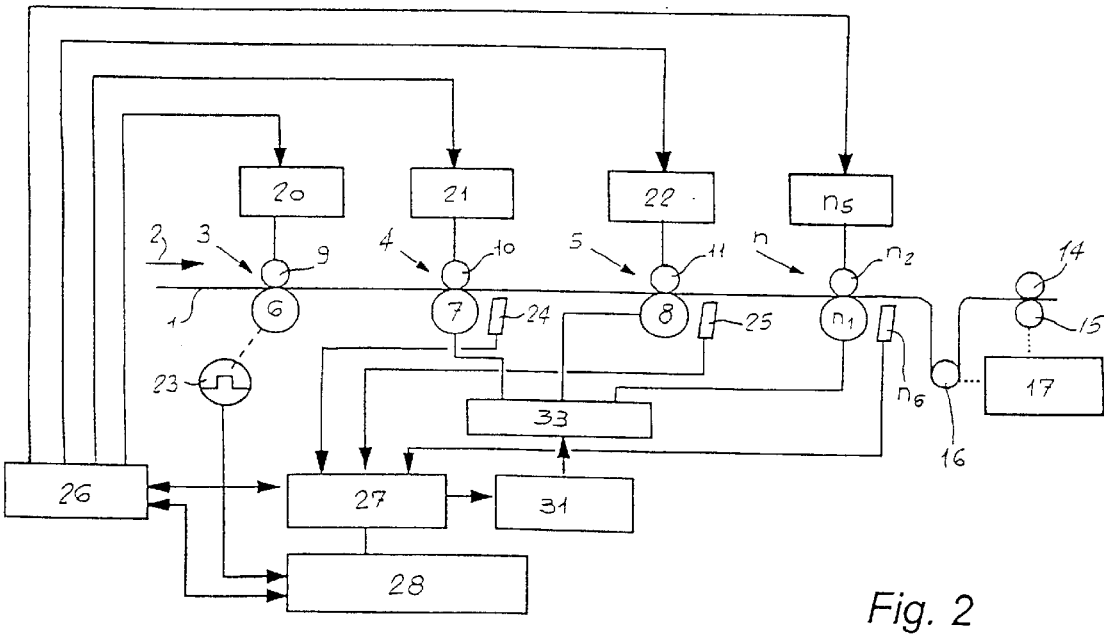
FIG. 2 is a schematic view of the components of a rotary printing machine without compensating rollers.

FIG. 2 is a schematic view of the components of a rotary printing machine without compensating rollers, this to illustrate an application of the automatic phasing method to another kind of rotary printing machine. The various components shown in this figure are defined with the same reference numerals as those used in relation with FIG. 1, excluding the component related to the rotation control of the plate cylinders 6, 7, 8 and n1 since in this case, the register setting operations will not be carried out by moving compensating rollers but by acting directly on the rotation of the plate cylinders 6, 7, 8 and n1 by the means of a control circuit 33 of the rotation of the plate cylinders 6, 7, 8 and n1. To this end, it is also suitable to associate a pulse generator 23 with each plate cylinder 6, 7, 8 and n1. In order to unnecessarily load the figure, only one pulse generator 23 is shown here, but it is quite clear that there should be as many pulse generators as there are plate cylinders. These pulse generators are usually arranged at one end of the drive shaft of the plate cylinders.

Figure 3:
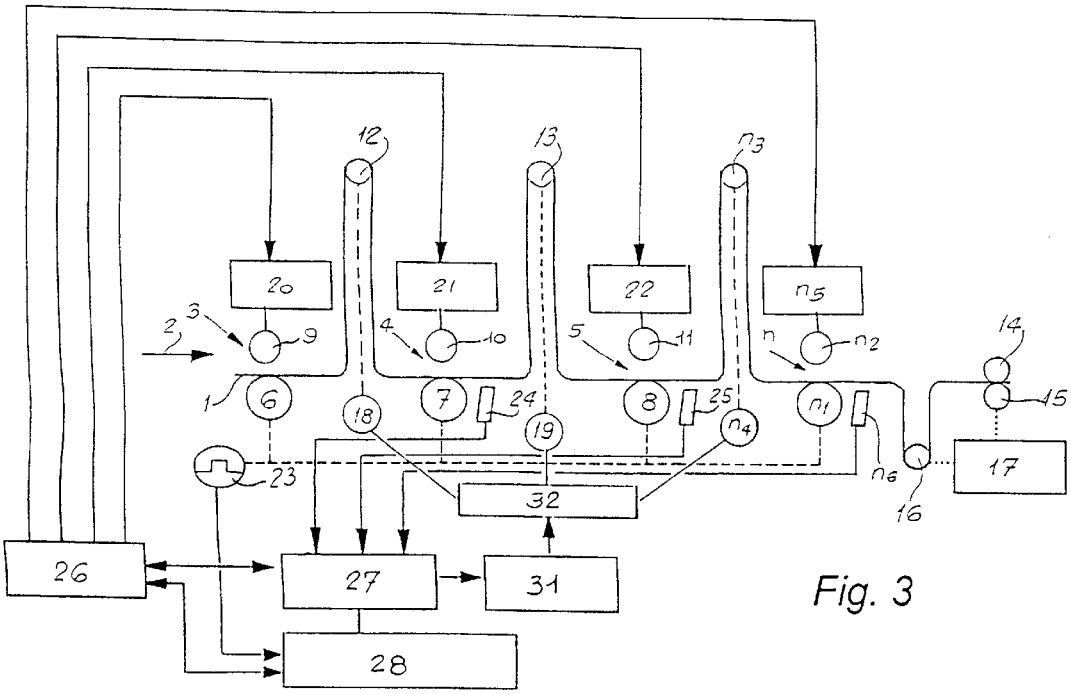
FIG. 3 is a schematic view of the components of a rotary printing machine at the beginning of the automatic register setting operation.

FIG. 3 is a schematic view of the components of a rotary printing machine at the beginning of the automatic register setting operation. In this initial configuration, all the pressing cylinders 9 to n2 are in a raised position, which allows to place the web to be printed 1 pinched downstream by the pair of pull rollers 14, 15. The plate cylinders 6 to n1 have been inserted in their position without any register of their angular position. Since the pressing cylinders are raised, the web to be printed is still blank and does not include any printing even when travelling above the plate cylinders. No information about the length of the web path between the units is necessary. The compensating rollers 12 to n3 can thus occupy any position but it is advisable to center them beforehand. For economy reasons of the substrate to be printed, the web preferably travels at reduced speed during all the phases necessary for the register setting of printings. It is not necessary to position the scanning heads, which can be moved transversely with respect to the web travelling direction of the web on the running line of the register marks.

Figure 4:
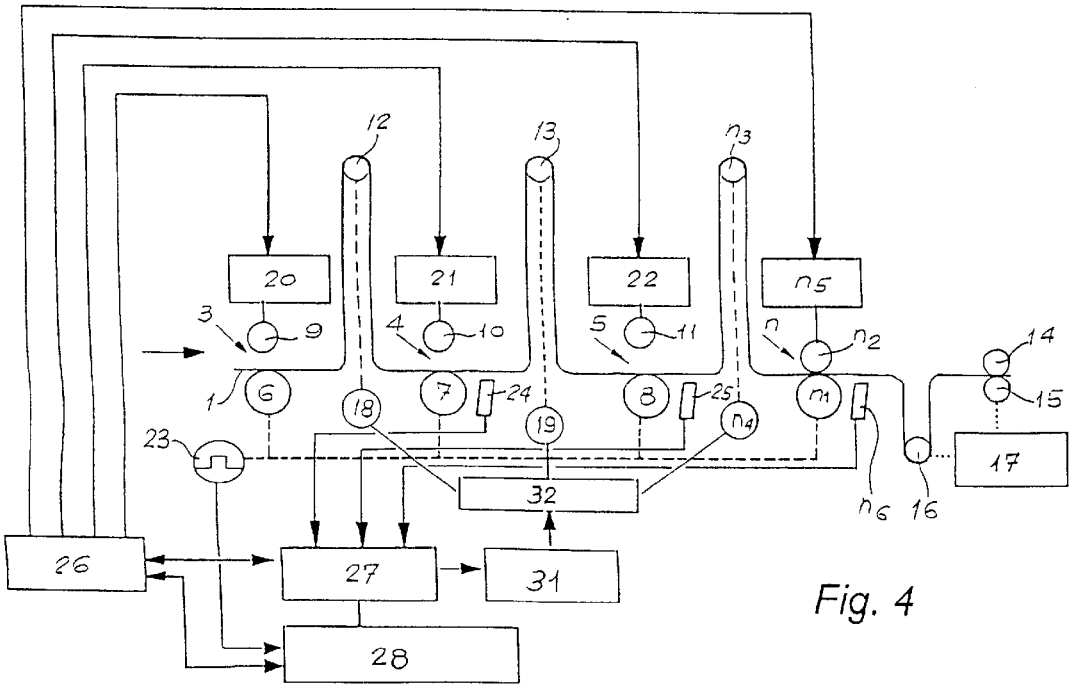
FIG. 4 is a schematic view of the components of a rotary printing machine in the first phase of the automatic register setting operation.

FIG. 4 is a schematic view of the components of a rotary printing machine in the first phase of automatic register setting. In this first phase, where the web to be printed 1 preferably travels at low speed, the last pressing cylinder n2 is lowered until pressing the web to be printed 1 against the corresponding plate cylinder n1. The scanning head n6 is then able to scan the printing on the web to be printed 1, and to detect the register mark of the corresponding unit n which is printed at the same time as the image of the printing plate or the engraved cylinder. Once detected, the localization of this register mark can be easily stored by recording the increment of the pulse generator corresponding to the time of the detection. If the register mark would not have been detected by the scanning head, a signal will be emitted in order to move it transversely until to be in line with the running line of the register marks. A second signal will be received when the scanning head will be in an accurate position. Among the whole printing extent, only the register mark must be detected by the scanning head. Since the position of this register mark is immovable with respect to the image of the printing plate or the engraved cylinder and since said mark cyclically appears, a scanning gate can be created around this register mark in order to avoid all the "background noise" issued from the scanning of the remaining printing. This operation of placing a scanning gate around the register mark is called phasing operation.

Figure 5:
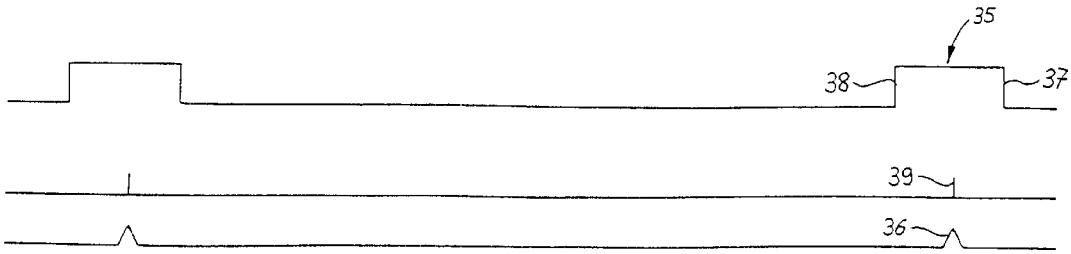
FIG. 5 is a diagram of the phasing operation.

FIG. 5 shows a diagram of this phasing operation usually performed successively in the upsteam direction all the printing units in a separate manner. Concretely, the phasing of the printing unit n is carried out in the following way: the number of pulses, generated by the pulse generator 23 is, first counted from a relative origin belonging to the corresponding plate cylinder, until said register mark 36 is detected by the scanning head n6. The pulse number corresponds to the necessary rotation of the plate cylinder n1 until said register mark 36 appears in front of the scanning head n6. The detection of this register mark will immediately involve the storing of the increment of the pulse generator at this moment, e.g. the increment number two hundred if the pulse generator comprises, for example, 3600 for a cylinder revolution. By means of an electronic circuit, a scanning gate 35 will be created around the register mark 36 of unit n and the position of this scanning gate 35 will be stored by recording the increment numbers, for example, the increment number one hundred and fifty and the increment two hundred and fifty of the pulse generator, corresponding to the beginning 37 and to the end 38 of the scanning gate 35. The automatic phasing will thus be achieved while securing that the register mark will always be inside the corresponding scanning gate.

Figure 6:
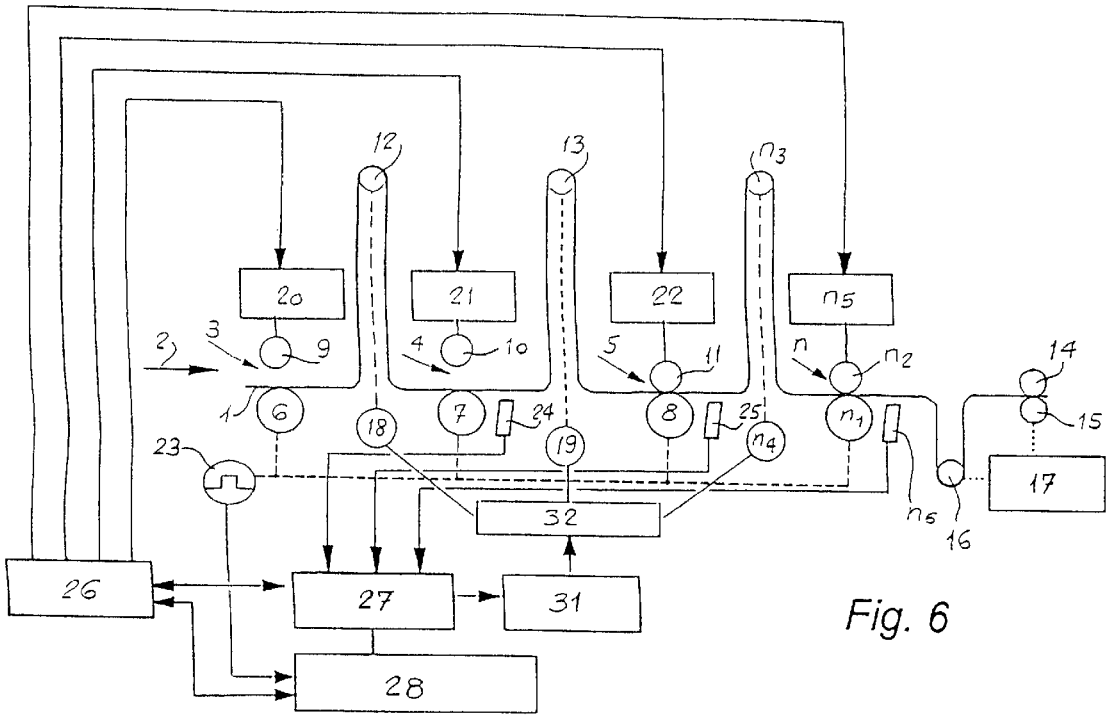
FIG. 6 is a schematic view of the components of a rotary printing machine in the second phase of the automatic register setting operation.
Figure 7:
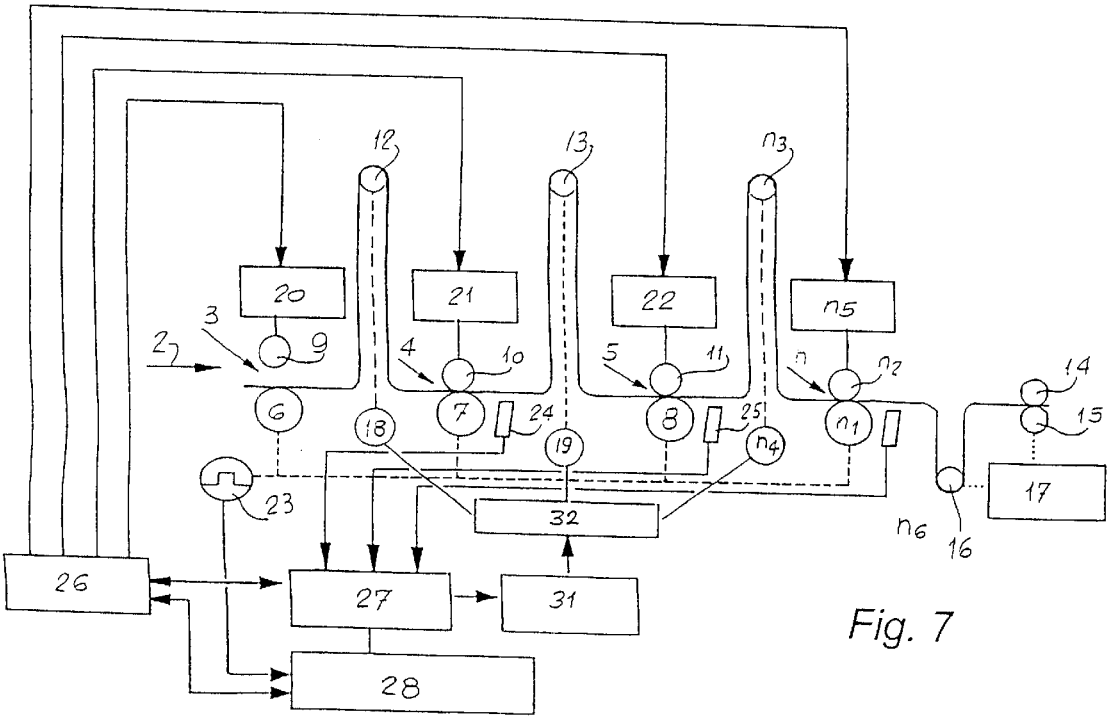
FIG. 7 is a schematic view of the components of a rotary printing machine in the third phase of the automatic register setting operation.

FIGS. 6 and 7 are schematic views of the components of a rotary printing machine, respectively in the second and in the third phase of the automatic register setting operation. These two phases are proceeding in a perfectly identical way with the method described for the first phase of the automatic register setting. Thus, the pressing cylinders 11 and 10 are successively lowered once that, for each of them, the previous phase is entirely achieved. Thereby, for each following printing unit 4 and 5 equipped with scanning heads 24, 25, the phasing operation is carried out with a web to be printed 1 including only one printing, that of the printing unit of the phase in question. This advantage results from the opposite direction according to which the pressing cylinders are successively lowered with respect to the travelling direction of the web to be printed. The scanning heads can easily detect the register mark 36 of the unit in question, and the phasing operation and the storing of the position of the scanning gate 35 open around the register marks 36 can be successively carried out for each of these printing units with no risk for such a register mark to be lost in an unfortunate superimposition of printings.

If all the scanning heads were already accurately positioned from the very start of the first automatic register setting operation, it should be noted that the phasing operation can be performed in only one and unique phase by simultaneously lowering the pressing cylinders 10 to n2 of all the concerned printing units. Effectively, if the scanning heads are already correctly positioned, they will not fail in detecting the register mark of the associated printing unit.

If one or more printing units deposit films without pigment, such as varnishes, on the web to be printed consequently, the register marks will be invisible and non-detectable by the said scanning heads. To obviate such a problem which obviously affects the phasing operation as described, a simple solution consists in phasing in any case the plate cylinders of these varnisher units by initially placing them in a located angular position; for example at twelve o'clock. The phasing operation of such a printing unit being thus achieved by default, the lowering of the pressing cylinder of this printing unit can then be performed at the same time as the lowering of the pressing cylinder of the following adjacent printing unit, located upstream.

Figure 8:
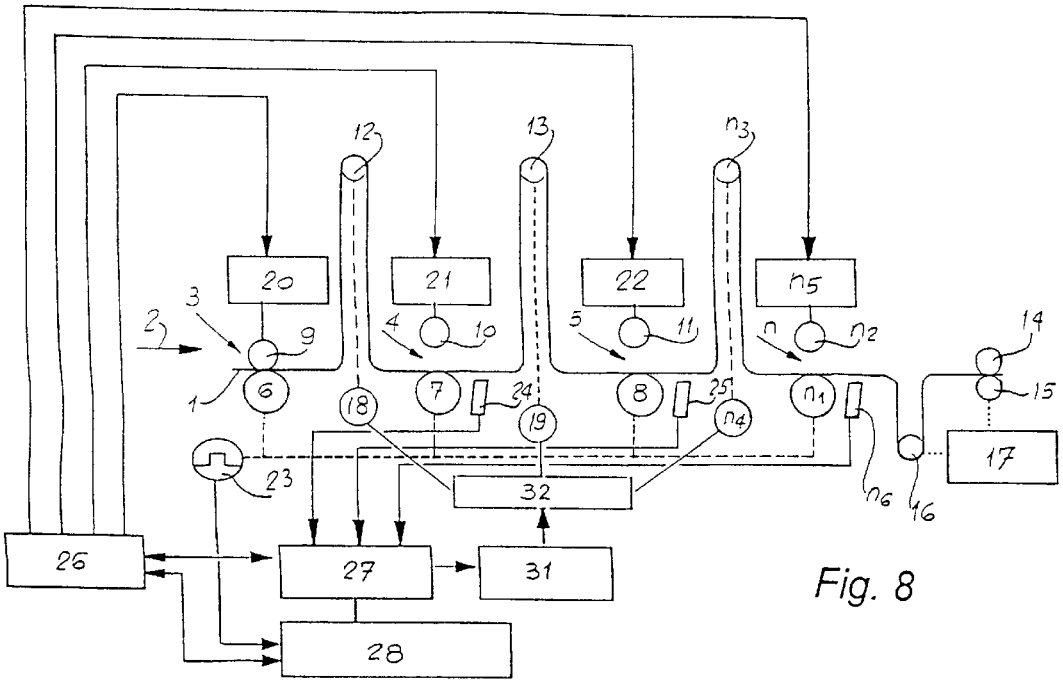
FIG. 8 is a schematic view of the components of a rotary printing machine in the fourth phase of the automatic register setting operation.

FIG. 8 schematically shows the components of a rotary printing machine during the fourth start-up phase. The phasing having been achieved, the pressing cylinders 10 to n2 are raised, which will remove the printings of the printing units 4 to n, which will no more be able to print the pattern of their printing plate or of their engraved cylinder on the web to be printed 1. Only the first pressing cylinder 9, located upstream, is lowered preferentially at the same time but not before the other pressing cylinders are raised. Consequently, only the register mark of the printing unit 3 will be printed on the web 1. In the scanning gate, previously defined for each printing unit 4 to n, a virtual register mark 39 will be electronically created and located in the middle of the scanning gate 35.

Figure 9:
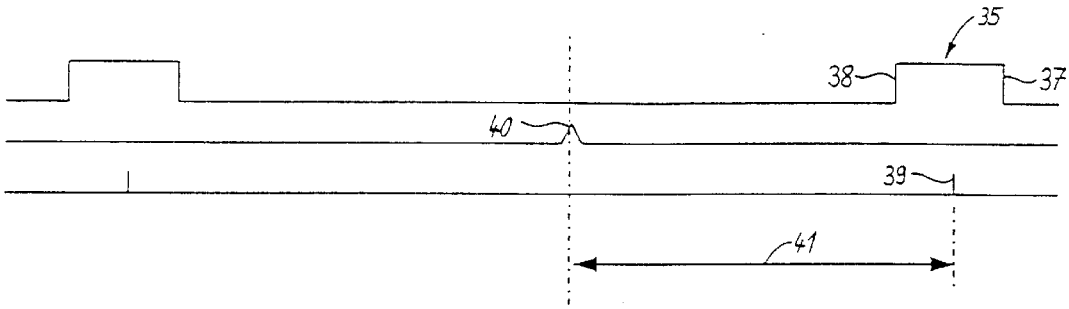
FIG. 9 is a diagram of the calculation of the register error in a "mark-to-cylinder" mode.
Figure 10:
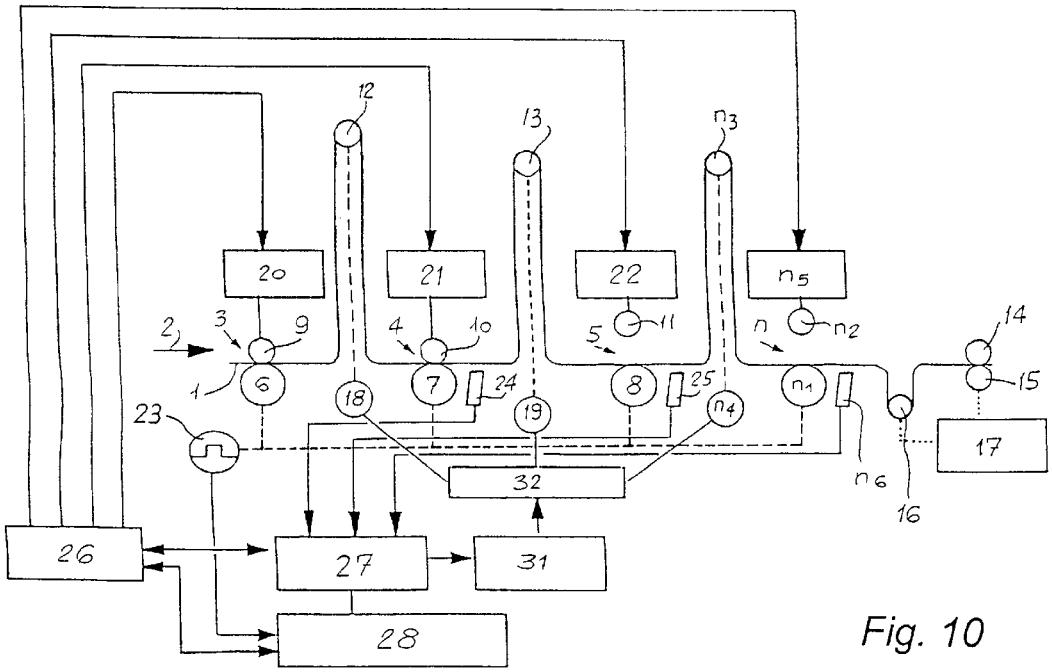
FIG. 10 is a schematic view of the components of a rotary printing machine in the fifth phase of the automatic register setting operation.

FIG. 9 shows the utility of such a virtual register mark 39 in a diagram of the calculation of the register error 41 in a mode called "mark-to-cylinder". The position of the virtual register mark 39 is stored during the phasing operation or is calculated with the known increments 37, 38 corresponding to the beginning and the end of the scanning gate 35. Then, by means of the scanning head 24 of the printing unit 4, the register mark 40 printed by the first printing unit 3 located most upstream will be detected. The register error 41 between the virtual mark 39 and the register mark 40 of the first printing unit 3 can thus be easily determined by substraction of the stored increments. The aim of this correction is to equate the register mark 40 of the first printing unit 3 with the virtual register mark 39. Physically, the correction of the register error 41 is effected, for the printing unit 4, by moving the compensating roller 12 located just upstream of this printing unit 4 (FIG. 10). This correction involves a moving in the opposite direction of the dancer roller or another compensatory effect on another control unit attached to the tension unit 16. Since the web to be printed 1 is pinched upstream only by the printing unit 3 and downstream only by the pair of pull rollers 14, 15, the correction of the register error 41 effects with a constant tension without causing an increase or a reduction of the tension of the web to be printed 1. This operation is possible due to the fact that the web is not moved by pinching along the path between the compensating roller 12 in question and the pull rollers 14, 15. For the printing unit 4, the so called "mark-to-cylinder" register is thus realized.

FIG. 10 schematically shows the components of a rotary printing machine in the fifth phase of the automatic register setting operation. At this stage, the first register mark 40 printed by the first printing unit 3 reaches now the second compensating roller 13, located between the printing units 4 and 5. The pressing cylinder 10 of the second printing unit 4 is lowered, and the image of the plate cylinder 7 is printed on the web to be printed 1 with the corresponding register mark 36 printed by the printing unit 4.

Figure 11:
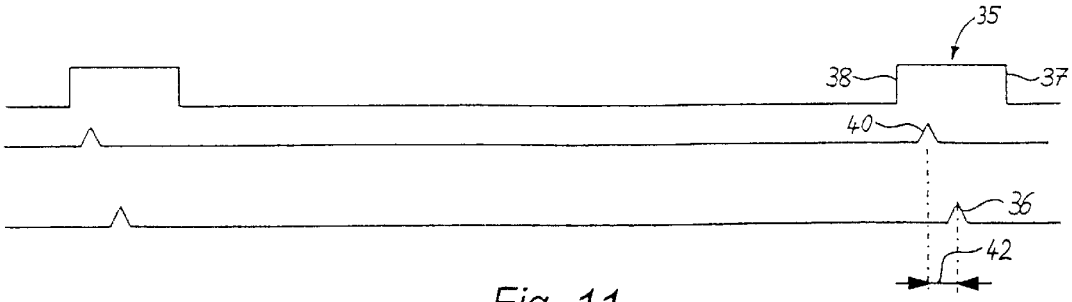
FIG. 11 is a diagram of the calculation of the register error in a "mark-to-mark" mode.

FIG. 11 shows a diagram of the calculation of the residual register error 42 in a precise mode called "mark-to-mark". The phasing and calculation operations of the register error 41 in the "mark-to-cylinder" mode having been achieved for all the printing units, the register marks 40 and 36 of the respective units 3 and 4 thus appear in the same scanning gate 35 detected by the scanning head 24. However, due to various variable causes substantially affecting the printed substrate (degree of humidity, web homogeneity and other ambient working conditions), this web can be liable to small lengthenings which consequently cause a slight shift of the register mark 36 with respect to the register mark 40 of the first printing unit 3 used as reference. The conventional system of register control, such as, for example, the one described in patent CH 539 509, will allow to correct this residual register error 42 by acting, for example, on the control circuit 32 of the motors controlling the movings of the compensating rollers, or by acting on the control circuit 33 controlling the rotation of the plate cylinders.

Figure 12:
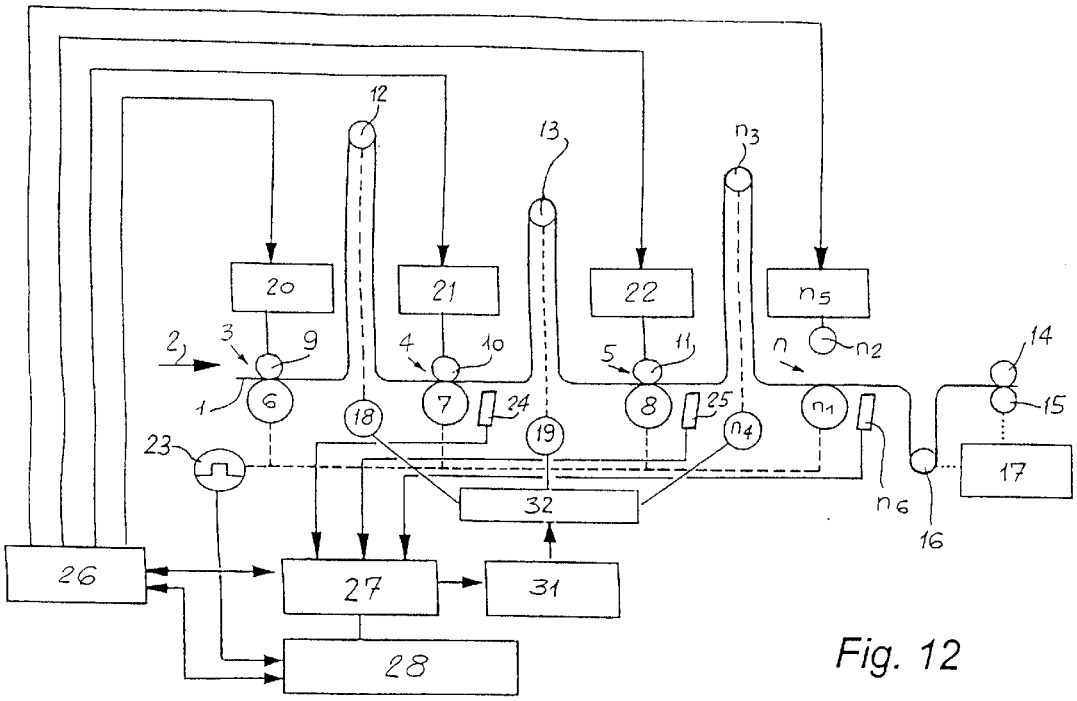
FIG. 12 is a schematic view of the components of a rotary printing machine in the sixth phase of the automatic register setting operation.

FIG. 12 is a schematic view of the components of a rotary printing machine in the sixth phase of the automatic register setting operation. This sixth phase effects in the same way as previously described in connection with FIGS. 10 and 11. The first register mark 40, printed by the first printing unit 3, reaches now the next printing unit 5. The calculation and correction of the "marks-to-cylinder" error can be performed by the printing unit 5 in the same way as for the preceding printing unit. At this stage, the preceding printing issued from the printing unit 4 is located itself only on the level of the second compensating roller 13. Thus, in a same succession of operations, when the pressing cylinder 11 is lowered, the printing printed by the preceding plate cylinder 7 has not yet reached the level of the printing unit 5 in question. Thereby the image of the corresponding plate cylinder 8 is printed with its register mark 36 on the web to be printed 1 which, at this place, is only printed with the first printing including the register mark 40 printed by the first plate cylinder 6. The calculation and correction of the residual register error 42 in the mode "mark-to-mark" can be undertaken after detection by the scanning head 25 of the reference register mark 40 and of the register mark 36 of unit 5 in question.

Figure 13:
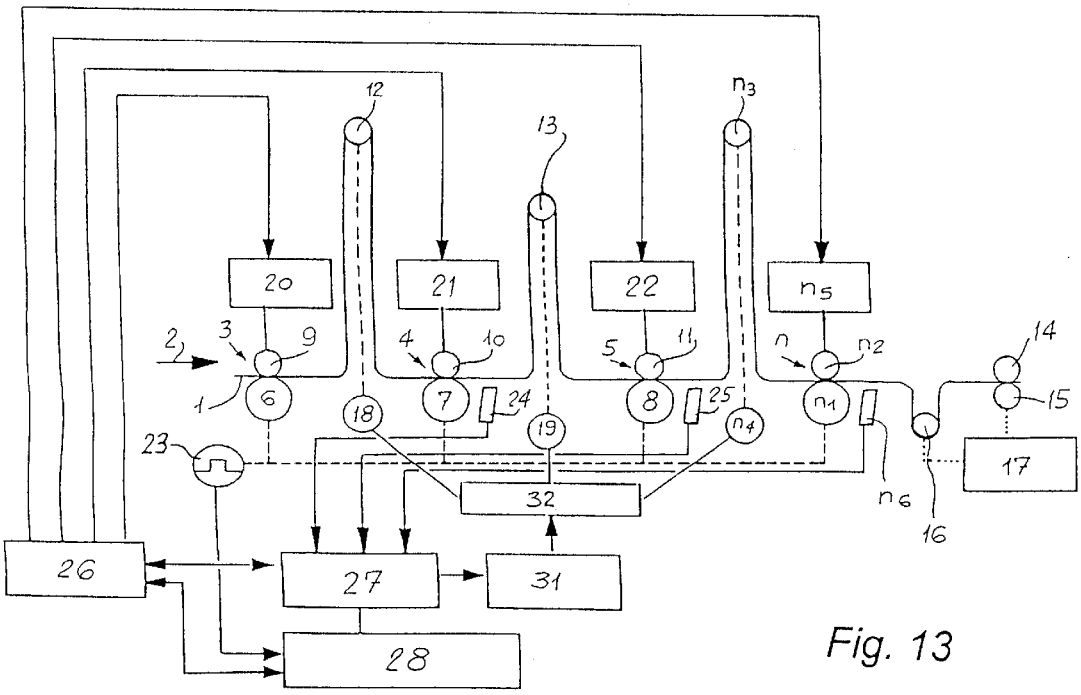
FIG. 13 is a schematic view of the components of a rotary printing machine in the last phase of the automatic register setting operation.

FIG. 13 is a schematic view of the components of a rotary printing machine in the last phase of the automatic register setting. In a similar way, it will be proceded to the "mark-to-cylinder" calculation between the register mark 40 of the first plate cylinder 6 and the virtual register mark 39 determined and stored after the phasing. Then, after having applied the correction values to the compensating roller n3, it will be proceeded to the calculations and corrections of the residual register error 42 in the mode "mark-to-mark" between the register mark 40 of the first plate cylinder 6 and the register mark 36 of the printing unit n in question. Once these corrections having been performed, all the colors are in register with one another and the method of automatic register setting is achieved. The rotary printing machine can thus, if necessary, operate at constant speed where the web to be printed 1 can then travel at high speed.

Obviously, the number of phases or stages given in this description depends on the number of printing units used to perform the desired printing jobs. However, the method remains in any case unchanged. If there are a plurality of printings of the same color, the use of a code or a pattern detection of the mark could be proposed to ensure the reliable detection of the register marks in the course of this method.

Numerous improvements can be brought to the subject matter of this invention within the scope of the claims.

What is claimed is:

1. A method for an automatic register setting of printings printed by plate cylinders in a rotary machine using inks of a plurality of colors, wherein the rotary machine comprises a succession of printing units respectively positioned downstream with respect to the travelling direction of a web to be printed, at least one pulse generator, two pull rollers located downstream of the printing units, compensating rollers used with the plate cylinders to correct register errors determined by means of register marks printed on the web when pressing cylinders are lowered against the plate cylinders, scanning heads each located near and downstream of the respective printing units, each printing unit includes one of the plate cylinders and one of the pressing cylinders which are controlled by one of a plurality of control devices, the method comprising the steps of:

a) lowering the last pressing cylinder;

b) aligning the scanning head of the printing unit so that it is positioned vertically to the successive pass of the register marks printed by the plate cylinder;

c) phasing the printing unit such that a scanning gate is placed around the register mark;

d) repeating the successive steps a), b) and c) for all the printing units, successively upstream, excluding the first printing unit located most upstream;

e) raising all of the pressing cylinders which have been previously lowered, and lowering the first pressing cylinder as soon as all the pressing cylinders raise up;

f) determining the register error in a mode called "mark-to-cylinder";

g) correcting, at a constant tension of the web, the register error by a compensating roller or a plate cylinder;

h) determining a residual register error in a mode called "mark-to-mark";

i) correcting the residual register error with a compensating roller or a plate cylinder; and j) repeating the successive stages f), g), h), i) for all the printing units, successively downstream, starting from the second printing unit.

2. The method of claim 1, wherein the step of phasing consists of electronically placing, by increments provided by the pulse generator, a scanning gate around the register mark, and of determining and storing the increment value which corresponds to the position of the register mark in order to define a virtual register mark.

3. The method of claim 2, wherein the step of determining the register error of the plate cylinders in the mode called "mark-to-cylinder" consists of detecting by the scanning head of the concerned printing unit, the register mark printed by the first printing unit, then of determining the difference between the register mark, used as reference, and the virtual register mark.

4. The method of claim 1, wherein the step determining the residual register error of the plate cylinders in the mode called "mark-to-mark" consists of lowering the pressing cylinder of the printing unit concerned, then of detecting by the corresponding scanning head the register mark printed by the first printing unit, and finally of determining the difference between the register mark, used as reference, and the register mark printed by the concerned printing unit.

5. The method of claim 4, wherein during the step of determining the residual register error in the mode "mark-to-mark", only the register mark of the printing unit concerned and the register mark of the first printing unit are detected by the scanning head of the printing unit concerned.

6. The method of claim 1, wherein the stages a), b), c) are simultaneously performed for all adjacent printing units whose scanning heads are already aligned before the corresponding pressing cylinders are lowered.

7. The method of claim 1, wherein any plate cylinder which deposits on the web to be printed a film of invisible ink will be initially located in a registered angular position.

8. The method of claim 1, wherein the use of more than one register mark per plate cylinder leads to a use of a code referring to the register marks to differentiate them.

9. A device for providing an automatic register setting of printings printed by plate cylinders, the device comprising:

a rotary machine using inks of a plurality of colors, the rotary machine comprising a succession of printing units respectively positioned downstream with respect to the traveling direction of a web to be printed;

at least one pulse generator;

two pull rollers located downstream of the printing units;

pressing cylinders that are lowered against the plate cylinders to determine register errors by means of register marks printed on the web;

compensating rollers cooperating with the plate cylinders to correct the register errors;

scanning heads, each of the scanning heads located near and downstream to the respective printing units, wherein each printing unit includes one of the plate cylinders and one of the pressing cylinders which are controlled by one of a plurality of control devices, wherein the device performs the functions of:

a) lowering the last pressing cylinder;

b) aligning the scanning head of the printing unit so that it is positioned vertically to the successive pass of the register marks printed by the plate cylinder;

c) phasing the printing unit such that a scanning gate is placed around the register mark;

d) repeating the successive steps a), b) and c) for all the printing units, successively upstream, excluding the first printing unit located most upstream;

e) raising all of the pressing cylinders which have been previously lowered, and lowering the first pressing cylinder as soon as all the pressing cylinders raise up;

f) determining the register error in a mode called "mark-to-cylinder";

g) correcting, at a constant tension of the web, the register error by a compensating roller or a plate cylinder;

h) determining a residual register error in a mode called "mark-to-mark";

i) correcting the residual register error by a compensating roller or a plate cylinder; and j) repeating the successive stages f), g), h), i) for all the printing units, successively downstream, starting from the second printing unit, and wherein the control devices of the pressing cylinders are controlled by an automatic control circuit connected to a calculation circuit of a register error.

10. The device of claim 9, wherein all of the plate cylinders are connected to a single and same pulse generator when only the compensating rollers are used to correct the register errors.

11. The device of claim 9, wherein each plate cylinder is equipped with and connected to a pulse generator when only the plate cylinders are used to correct the register errors.

* * * * *